US005894971A

United States Patent [19]

Huang

[11] Patent Number: 5,894,971

[45] Date of Patent: Apr. 20, 1999

[54] TOOL HOLDER FOR ATTACHING TOOLS TO USER'S HAND

[76] Inventor: Te Chien Huang, No. 6, Avenue 32, Lane 300, Sec. 2, Ching Hai Road, Taichung, Taiwan

[21] Appl. No.: 09/016,979

[22] Filed: Feb. 2, 1998

[51] Int. Cl.[6] ..... A45C 11/00; B65D 15/28

[52] U.S. Cl. ..... 224/218; 206/372; 206/373; 224/219

[58] Field of Search ..... 224/218, 219, 224/904; 206/372, 373, 305; 451/463, 464, 469

[56] References Cited

U.S. PATENT DOCUMENTS 4,797,040 1/1989 Hibbard ..... 408/241 R 5,009,347 4/1991 Phelps ..... 224/219

5,257,729 11/1993 Silvernail ..... 224/219

FOREIGN PATENT DOCUMENTS 2048475 2/1993 Canada ..... 224/219

*Primary Examiner*—Allan N. Shoap

*Assistant Examiner*—Maerena W. Brevard

[57] ABSTRACT

A tool holder includes a strip having a number of live hinges for allowing the strip to be folded to a housing having a base panel and a cover panel. Two or more bags for receiving tools are pivotally coupled to the strip at a live hinge for allowing the bags to be rotated relative to the strip. The strip includes one or more belts for securing the tool holder to the hand of the user. The cover panel may be engaged with the base panel for exposing the bags and may be folded to engage with the bags for stably retaining the tools in place.

4 Claims, 7 Drawing Sheets

TOOL HOLDER FOR ATTACHING TOOLS TO USER'S HAND

BACKGROUND OF THE INVENTION

1. Field of the Invention

The present invention relates to a tool holder, and more particularly to a tool holder for attaching tools to the user's hands.

2. Description of the Prior Art

Typical tool holders are mostly provided for attaching the tools to the waist portion of the user and may not be used for attaching the tools to the hands of the user, such that the user may not easily obtain the tools.

The present invention has arisen to mitigate and/or obviate the afore-described disadvantages of the conventional tool holders.

SUMMARY OF THE INVENTION

The primary objective of the present invention is to provide a tool holder for attaching tools to the user's hand and for stably securing the tools in place.

In accordance with one aspect of the invention, there is provided a tool holder comprising a strip including a plurality of live hinges for allowing the strip to be folded to a housing having a base panel and a cover panel, the base panel including a bottom surface, the cover panel being allowed to be folded to engage with the bottom surface of the base panel, at least two bags for receiving tools and each pivotally coupled to the strip at a live hinge for allowing the bags to be rotated relative to the strip about the live hinges, and means for attaching the strip to a hand of a user. The cover panel is engaged with the bottom surface of the base panel for exposing the bags, and is adapted to be folded to engage with the bags for stably retaining the tools in place.

The first bag includes a length shorter than that of the second bag for exposing the tools. The bags each includes a plate pivotally coupled to the strip at the live hinge for allowing the plate to be rotated relative to the strip about the live hinge, and each includes a cap secured to the plate for forming the bags. The bags each includes an opening having a resilient band for resiliently and stably retaining the tools in the bags.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
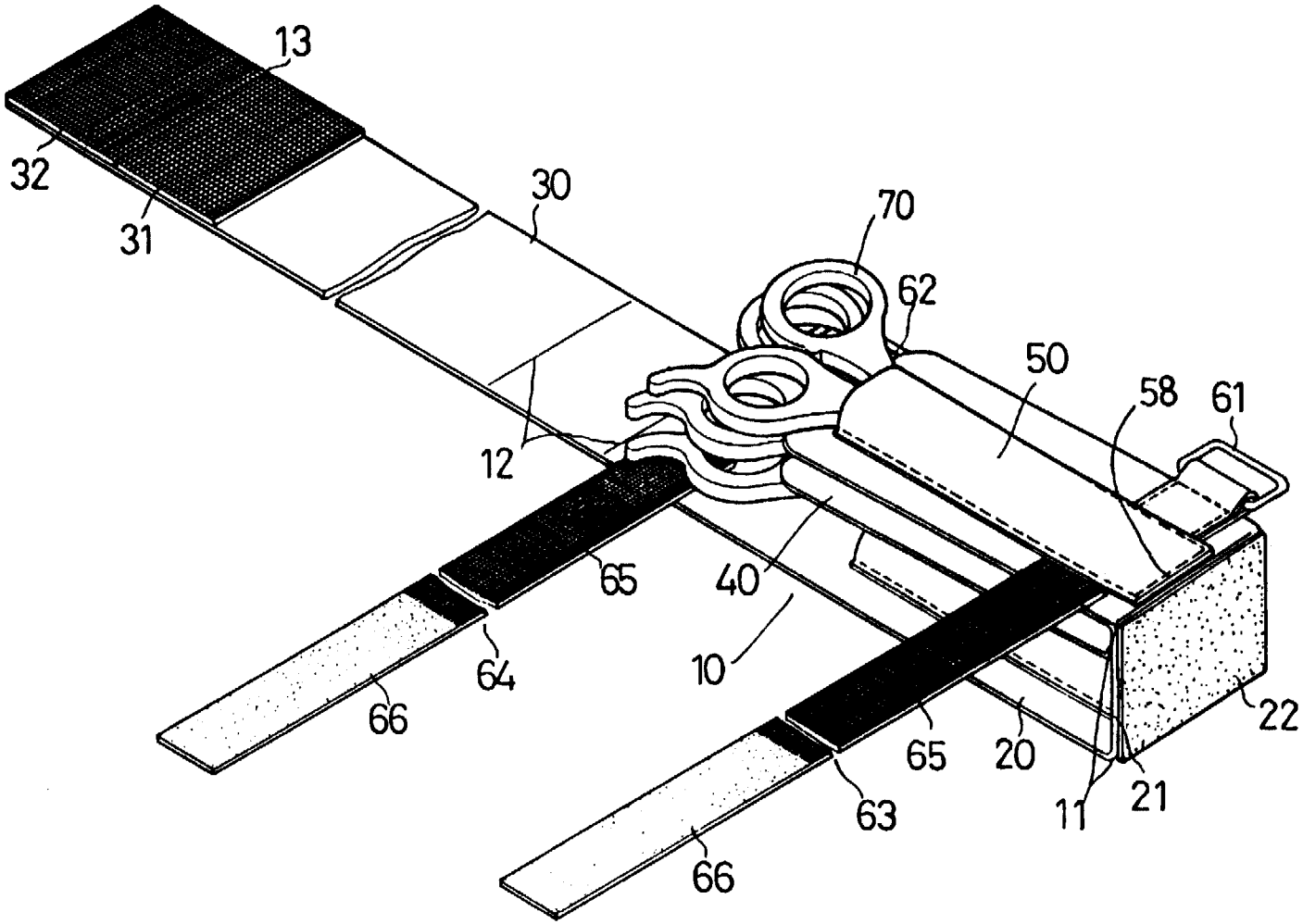
FIGS. 1, 2, 3 are perspective views illustrating the applications of a tool holder in accordance with the present invention.
Figure 2:
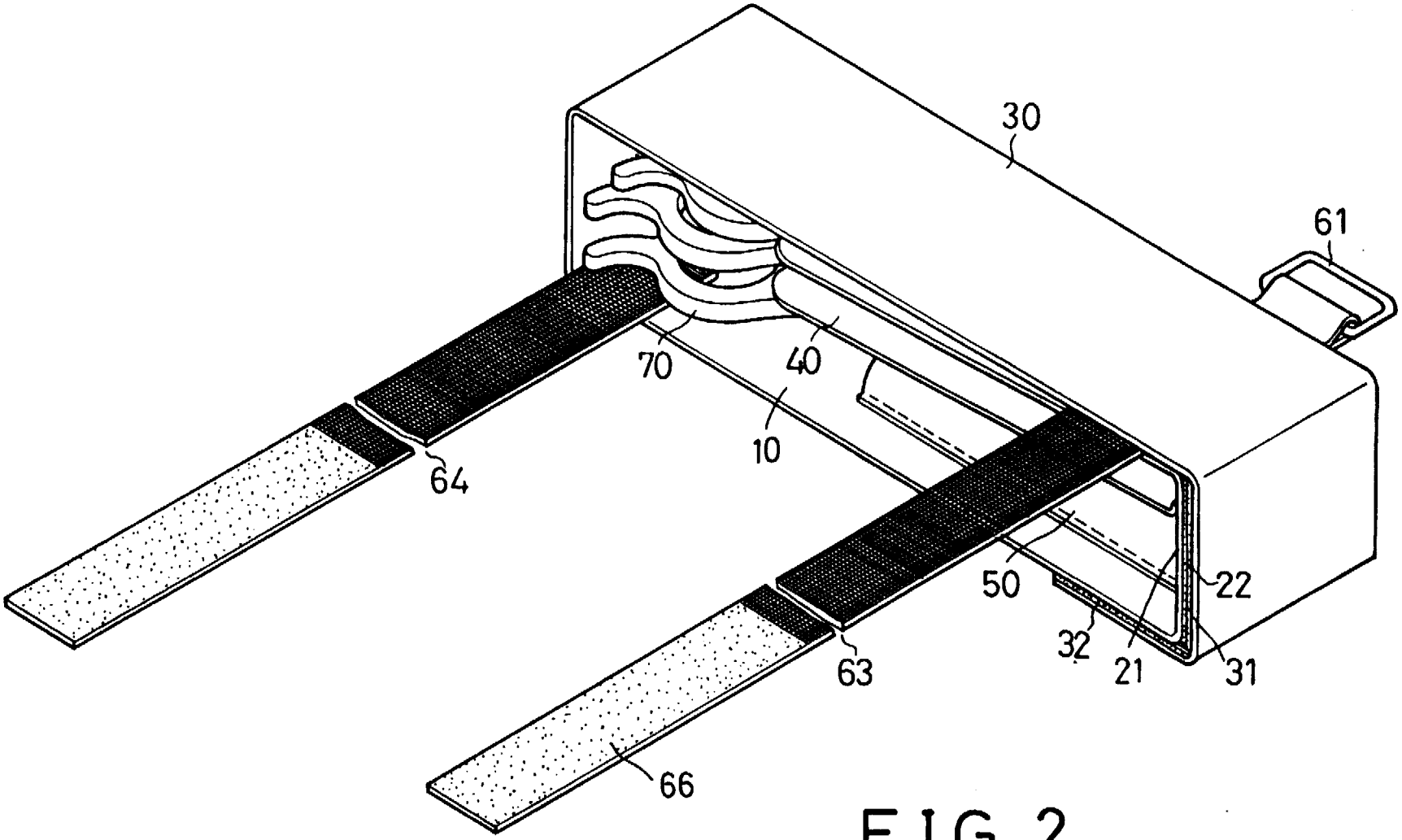
Figure 3:
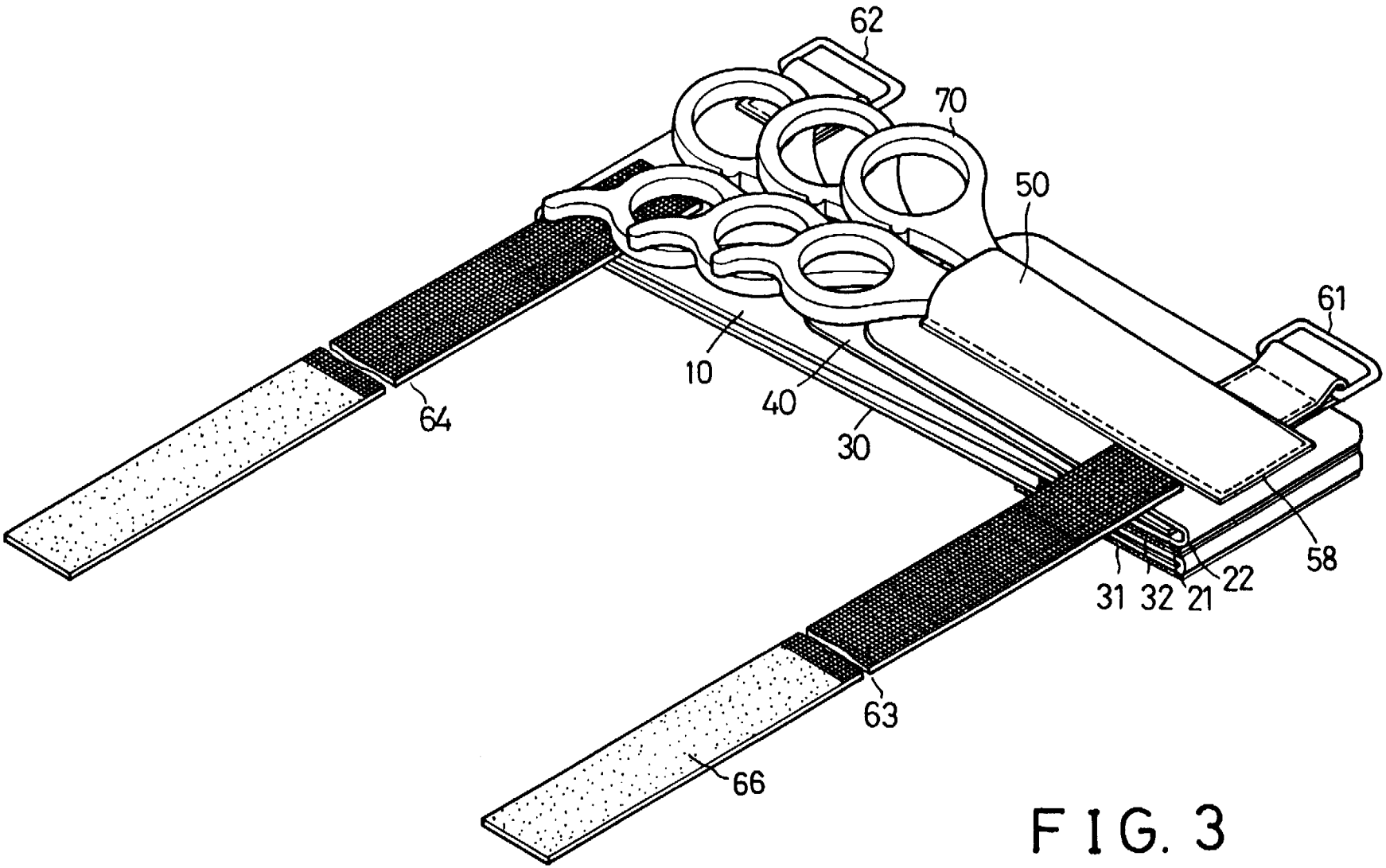
Figure 4:
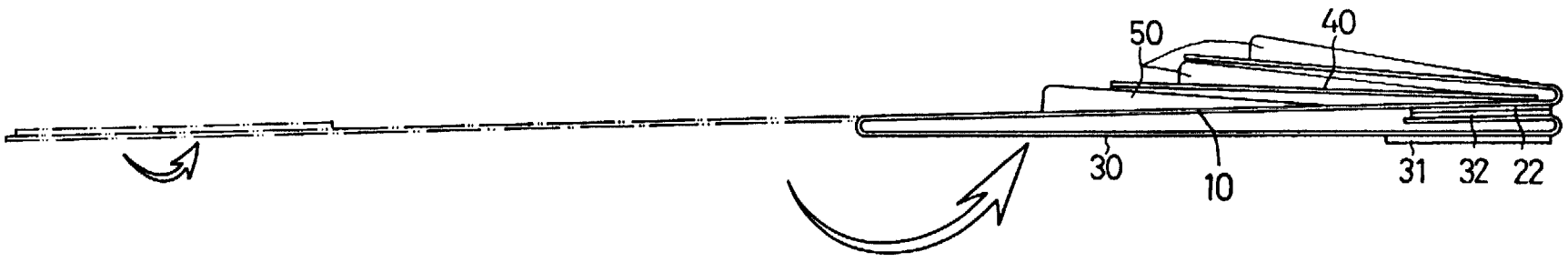
FIG. 4 is a plan view illustrating the operation of the tool holder.

Referring to the drawings, and initially to FIGS. 1–4, a tool holder in accordance with the present invention is provided for attaching tools 70 to the hand(s) 80 of the user and comprises a strip 10 having a number of live hinges 11, 12, 13 for allowing the strip 10 to be folded to form a substantially parallelepiped housing which includes a base panel and a cover panel 30. A flap 21 is formed in one end of the strip 10 and foldable relative to the strip 10 about the live hinge 11 and includes a hook and loop device 22 for engaging with the other hook and loop devices 31, 32 that are provided in the other end of the strip 10 or in the free end of the cover panel 30. The cover panel 30 may be folded to engage with the bottom of the base panel (FIGS. 3–7) for exposing the tools 70.

Figure 5:
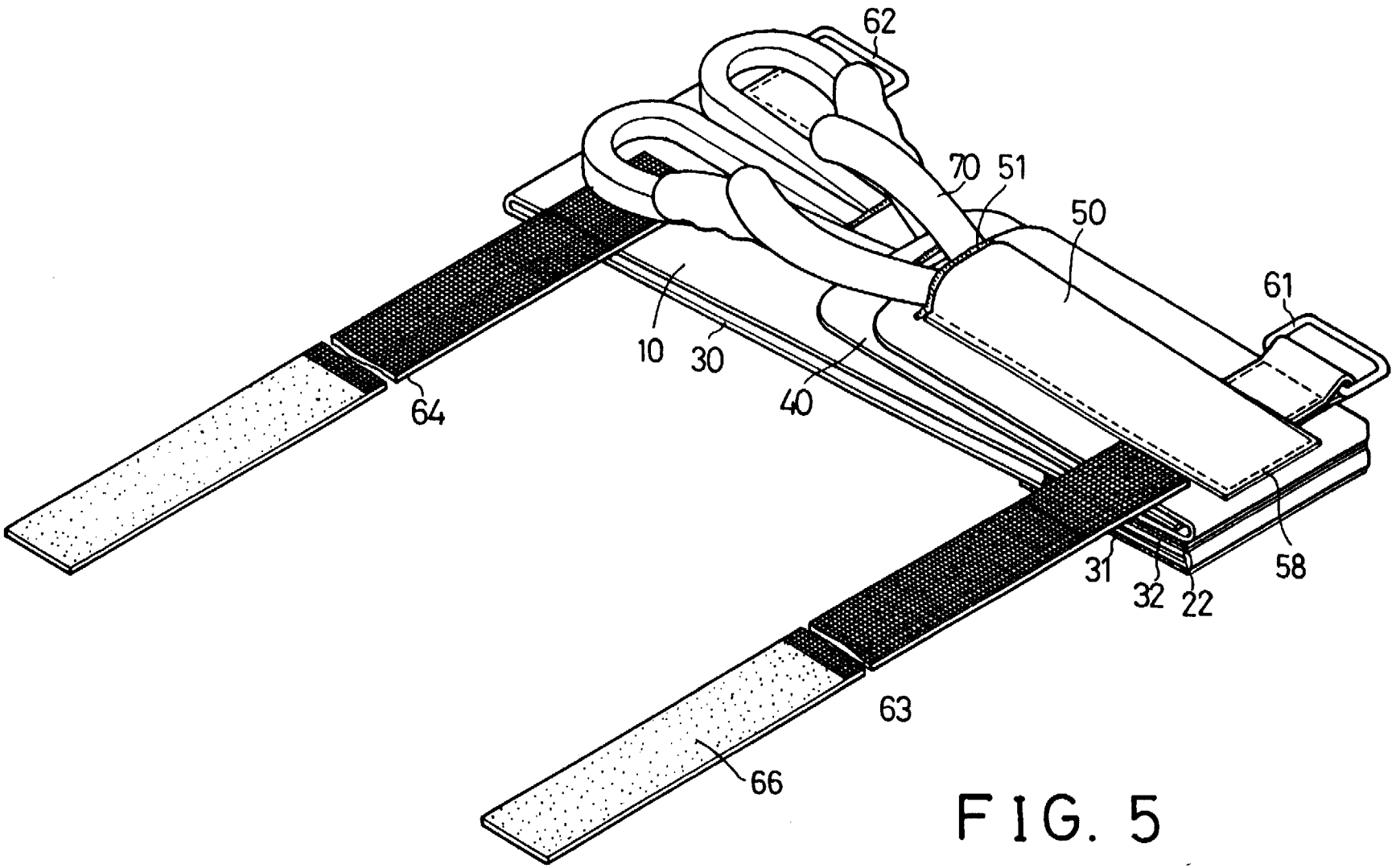
FIGS. 5, 6, 7 are perspective views illustrating the operation of the tool holder.
Figure 6:
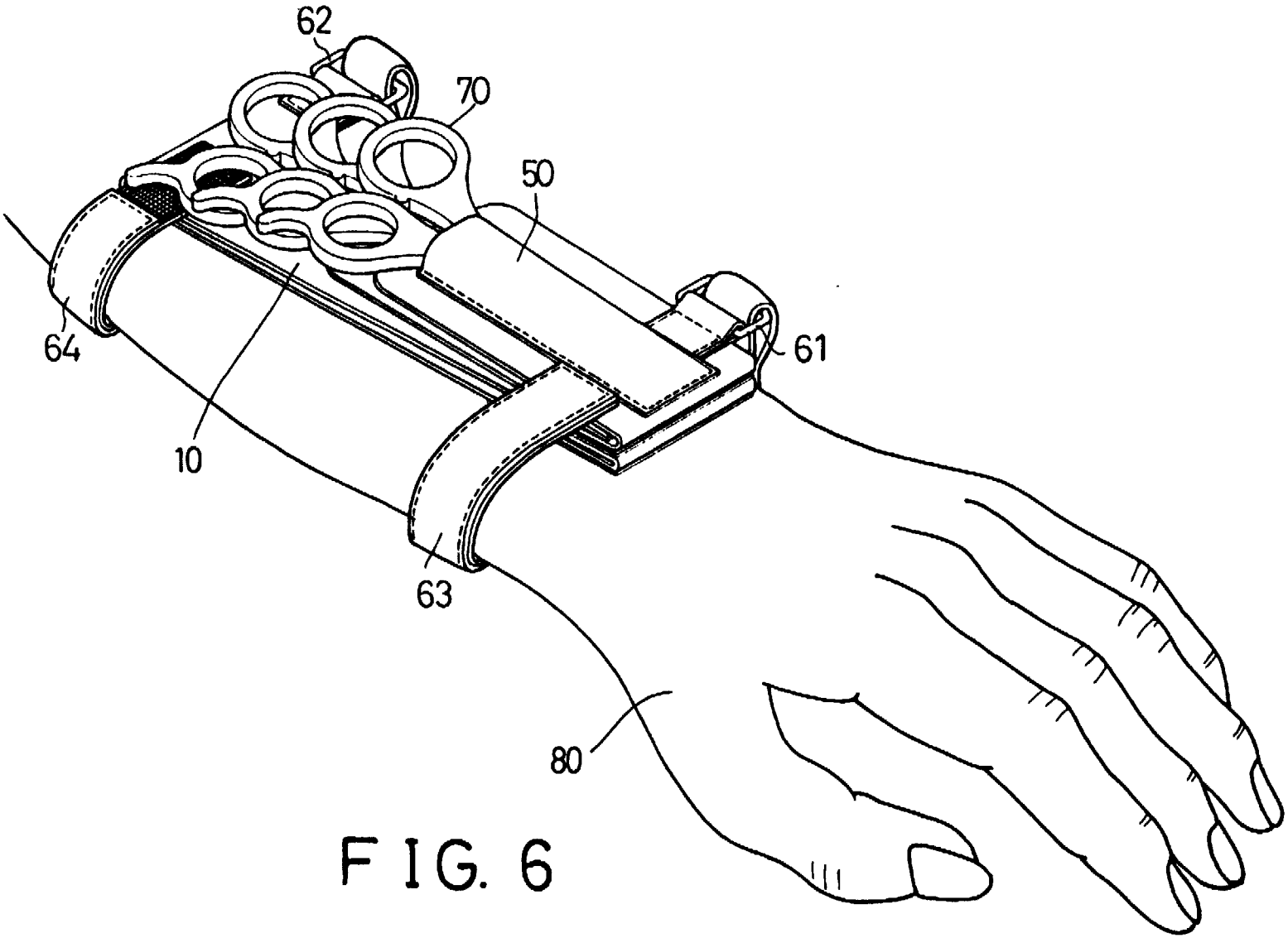
Figure 7:
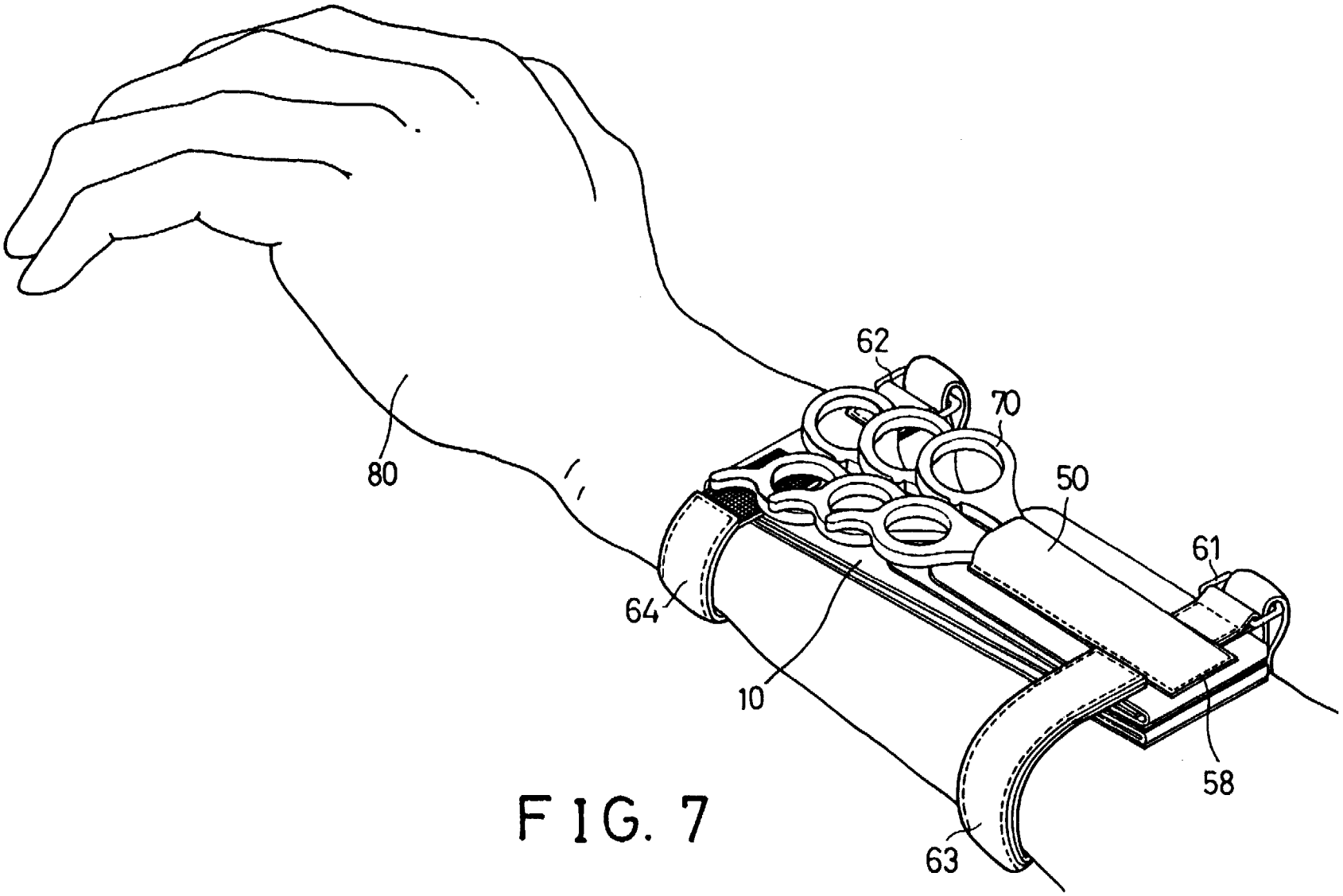

One or more plates 40 each has one end pivotally secured to the base panel of the strip 10 at a live hinge 58 and each has a cap 50 secured thereon for forming a bag and for engaging with the tools 70. The bags formed by the plates 40 and the caps 50 may be rotated about the live hinges 58 and include different lengths for receiving tools of different sizes and for allowing the tools to be easily obtained by the user. As shown in FIG. 5, at the open end of the bag, it is preferably that a resilient band 51 is provided for resiliently and stably retaining the tools 70 in the bags. One or more belts 63, 64 are secured to the strip 10 for engaging with the hand 80 of the user and for attaching the tools 70 to the hand 80. The belts 63, 64 each includes a ring 61 , 62 provided in one end and a hook and loop device 66 provided in the other end for securing the tool holder to the hand 80 of the user (FIGS. 6, 7). The hand grips of the tools 70 may be directed to the palm (FIG. 7) or away from the palm (FIG. 6) according to the user's need.

Referring again to FIG. 2, the strip 10 may be folded to form the housing for receiving the tools 70 and the bags 50 and for stably retaining the tools in place, such that no further packages are required for storing the tools and the tool holder.

Accordingly, the tool holder in accordance with the present invention may be provided for attaching tools to the hand of the user and for stably securing the tools in place.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool holder comprising:

a strip including a plurality of live hinges for allowing said strip to be folded to a housing having a base panel and a cover panel, said base panel including a bottom surface, said cover panel being allowed to be folded to engage with said bottom surface of said base panel, at least two bags provided for receiving tools and each being pivotally coupled to said strip at a live hinge for allowing said at least two bags to be rotated relative to said strip about said live hinges, and means for attaching said strip to a hand of a user, said cover panel being engaged with said bottom surface of said base panel for exposing said at least two bags, and being adapted to be folded to engage with said at least two bags for stably retaining the tools in place.

2. The tool holder according to claim 1, wherein a first of said at least two bags includes a length shorter than that of a second of said at least two bags for exposing the tools.

3. The tool holder according to claim 1 , wherein said at least two bags each includes a plate pivotally coupled to said strip at said live hinge for allowing said plate to be rotated relative to said strip about said live hinge, and each includes a cap secured to said plate for forming said at least two bags.

4. The tool holder according to claim 1, wherein said at least two bags each includes an opening having a resilient band for resiliently and stably retaining the tools in said at least two bags.

* * * * *